US010810870B2

(12) United States Patent
Wang et al.

(10) Patent No.: US 10,810,870 B2
(45) Date of Patent: Oct. 20, 2020

(54) METHOD OF PROCESSING PASSAGE RECORD AND DEVICE

(71) Applicant: Hangzhou Hikvision Digital Technology Co., Ltd., Hangzhou, Zhejiang (CN)

(72) Inventors: Long Wang, Zhejiang (CN); Yuyao Xu, Zhejiang (CN); Shifan Zhao, Zhejiang (CN)

(73) Assignee: Hangzhou Hikvision Digital Technology Co., Ltd., Hangzhou, Zhejiang (CN)

( * ) Notice: Subject to any disclaimer, the term of this patent is extended or adjusted under 35 U.S.C. 154(b) by 334 days.

(21) Appl. No.: 15/780,754

(22) PCT Filed: Aug. 25, 2016

(86) PCT No.: PCT/CN2016/096676
§ 371 (c)(1),
(2) Date: Jun. 1, 2018

(87) PCT Pub. No.: WO2017/092418
PCT Pub. Date: Jun. 8, 2017

(65) Prior Publication Data

US 2018/0357891 A1 Dec. 13, 2018

(30) Foreign Application Priority Data

Dec. 4, 2015 (CN) ..... 2015 1 0889455

(51) Int. Cl.
*G07C 5/00* (2006.01)
*G08G 1/01* (2006.01)
(Continued)

(52) U.S. Cl.
CPC ..... *G08G 1/0112* (2013.01); *G07C 5/08* (2013.01); *G07C 5/085* (2013.01); *G08G 1/017* (2013.01);
(Continued)

(58) Field of Classification Search
CPC .. G08G 1/0112; G08G 1/0108; G08G 1/0129; G08G 1/017; G07C 5/08; G07C 5/085; G07C 5/0841
See application file for complete search history.

(56) References Cited

U.S. PATENT DOCUMENTS

2014/0324326 A1 10/2014 Taylor
2015/0142485 A1 5/2015 Kiyama et al.
2018/0247505 A1* 8/2018 Arai ..... G08B 13/1963

FOREIGN PATENT DOCUMENTS

CN 101226687 A 7/2008
CN 101930668 A 12/2010
(Continued)

OTHER PUBLICATIONS

Extended European Search Report dated Sep. 10, 2019 in connection with EP Patent Application No. 16869729.0.
(Continued)

*Primary Examiner* — Ian Jen
(74) *Attorney, Agent, or Firm* — Wolf, Greenfield & Sacks, P.C.

(57) ABSTRACT

A method and device of processing vehicle passing records, which increase the accuracy of vehicle stop point analysis. The method includes: obtaining a plurality of vehicle passing records of a preset target object during a first preset time period (S102), wherein, the vehicle passing records include a gate number of a gate that the preset target object passes and vehicle passing time when passing the gate; obtaining a plurality of vehicle trajectories of the preset target object
(Continued)

based on the plurality of vehicle passing records (S104); performing stop point pre-processing on the vehicle trajectories to obtain pre-processed results (S106); obtaining pre-processed records that meet a first preset condition from the pre-processed results (S108); performing clustering processing on the pre-processed records to obtain clustering processing results; outputting the clustering processing results (S110).

19 Claims, 12 Drawing Sheets

(51) Int. Cl.
*G08G 1/017* (2006.01)
*G07C 5/08* (2006.01)

(52) U.S. Cl.
CPC ..... *G08G 1/0108* (2013.01); *G08G 1/0129* (2013.01)

(56) References Cited

FOREIGN PATENT DOCUMENTS

| | | | |
|---|---|---|---|
| CN | 102044163 | A | 5/2011 |
| CN | 102 629 297 | A | 8/2012 |
| CN | 103325245 | A | 9/2013 |
| CN | 104318327 | A | 1/2015 |
| CN | 104318766 | A | 1/2015 |
| CN | 104541131 | A | 4/2015 |
| CN | 104715612 | A | 6/2015 |
| CN | 104750800 | A | 7/2015 |
| CN | 104933870 | A | 9/2015 |
| CN | 104952248 | A | 9/2015 |
| CN | 104952273 | A | 9/2015 |
| CN | 104966129 | A | 10/2015 |
| JP | 2003042770 | A | 2/2003 |

OTHER PUBLICATIONS

PCT/CN2016/096676, Dec. 1, 2016, International Search Report and Written Opinion.
International Search Report and Written Opinion for Application No. PCT/CN2016/096676 dated Dec. 1, 2016.
EP16869729.0, Sep. 10, 2019, Extended European Search Report.

* cited by examiner

METHOD OF PROCESSING PASSAGE RECORD AND DEVICE

The present application is the U.S. National Phase under 35 U.S.C. 371 of PCT International Application No. PCT/CN2016/096676, filed Aug. 25, 2016 which claims the priority to a Chinese patent application No. 201510889455.8 filed with the State Intellectual Property Office of People's Republic of China on Dec. 4, 2015 and entitled "Method of processing passage record and device", the entire contents of which are incorporated herein by reference in their entirety.

TECHNICAL FIELD

The application relates to the field of data processing, and specifically, to a method and device of processing vehicle passing records.

BACKGROUND

In order to know the locations at which a vehicle appears during a designated time period, the stop points of the vehicle are analyzed, i.e., the locations at which the vehicle remains without leaving for a long time after having stopped are analyzed. At present, when stop points are analyzed, a user inputs a time range and a specific time period to be analyzed, e.g., the outgoing travel time period and the return travel time period during a day. As the specific time period of the vehicle can be set at will, the difficulty of pre-processing is increased. In records of large quantity of data, a user analyzes stop points in real time. The data processed are vehicle passing records of a designated vehicle passing all gates during a specific time period. The quantity of data to be processed is relatively large, and the time consumed is long. On the other hand, this method obtains all the gates passed by a designated vehicle during a specific time period within a time range and the numbers of times of the vehicle passing each gate. If the designated specific time period is not a time period in which the vehicle usually travels, then the results ultimately obtained are merely obtaining gates that have been passed. The results outputted are sets of isolated gates sorted in a decreasing order of number of times of vehicle passing. While they can reflect the regular passing gates, they will leave out many regular stop points, and cannot show the regions of the vehicle's stop points well. Therefore, the results obtained through this method are not accurate, and cannot achieve the purpose of analyzing stop points.

At present, no effective solution has been proposed for the problem of inaccurate analysis of vehicle stop points in relevant technologies.

SUMMARY OF THE INVENTION

The principal purpose of the application is to provide a method and device of processing vehicle passing records to solve the problem of inaccurate analysis of vehicle stop points.

To achieve the above-mentioned purpose, according to one aspect of the application, a method of processing vehicle passing records is provided, the method including: obtaining a plurality of vehicle passing records of a preset target object during a first preset time period, wherein, each of the vehicle passing records includes a gate number of a gate that the preset target object passes and vehicle passing time when passing the gate; obtaining a plurality of vehicle trajectories of the preset target object based on the plurality of vehicle passing records; performing stop point pre-processing on the vehicle trajectories to obtain pre-processed results; obtaining pre-processed records that meet a first preset condition from the pre-processed results; performing clustering processing on the pre-processed records to obtain clustering processing results; and, outputting the clustering processing results.

Optionally, obtaining a plurality of vehicle passing records of a preset target object during a preset time period includes: sorting the plurality of vehicle passing records in the order of vehicle passing time; obtaining time differences between adjacent vehicle passing records; classifying the plurality of vehicle passing records based on the time differences between adjacent vehicle passing records to obtain classified trajectories, wherein, the plurality of vehicle passing records are classified into a first class of vehicle passing records and a second class of vehicle passing records, the first class of vehicle passing records are adjacent vehicle passing records extracted from the plurality of vehicle passing records whose time differences exceed a second preset time, the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records.

Optionally, performing stop point pre-processing on the vehicle trajectories to obtain pre-processed results includes: obtaining the start point and the end point of each classified trajectory in the vehicle trajectories; obtaining the number of times the start point or the end point appears in the first preset time period, wherein, the number of times that the start point or the end point appears in the first preset time period is the number of times that vehicles pass a gate corresponding to the start point or the end point; and, obtaining the gate number of the gate corresponding to the start point or the end point, and the number of times that vehicles pass the gate corresponding to the start point or the end point to obtain the pre-processed results.

Optionally, after obtaining pre-processed records that meet a first preset condition from the pre-processed results, the method further includes: grouping the pre-processed records based on gate number to obtain a plurality of groups of pre-processed records, wherein, the pre-processed records of the same gate number are grouped into one group, and each gate number corresponds to each group of pre-processed records respectively; adding the numbers of times of vehicle passing corresponding to each group of pre-processed records together to obtain the total number of times of vehicle passing corresponding to each group; and, establishing a mapping relationship between each of the plurality of gate numbers and the total number of times of vehicle passing corresponding to each group.

Optionally, performing clustering processing on the pre-processed records to obtain clustering processing results includes: performing clustering processing on the plurality of gate numbers and the total number of times of vehicle passing corresponding to each group based on the mapping relationship to obtain clustering processing results, which consists of, specifically: obtaining the altitude and latitude information of gates of the plurality of groups; and, performing clustering processing on the plurality of gate numbers and the total number of times of vehicle passing corresponding to each group based on the altitude and latitude information of gates of the plurality of groups to obtain a plurality of classes of clustering processing results.

Optionally, after performing clustering processing on the pre-processed records to obtain a plurality of classes of clustering processing results, the method further includes: calculating the weight of each class of clustering processing results of the plurality of classes of clustering processing results in the plurality of classes of clustering processing results; outputting the clustering processing results, which includes: displaying the plurality of classes of clustering processing results, in combination with the weights, in different regions.

To achieve the above-mentioned purpose, according to another aspect of the application, a device of processing vehicle passing records is provided, the device includes: a first obtaining unit, configured for obtaining a plurality of vehicle passing records of a preset target object during a first preset time period, wherein, each of the vehicle passing records includes a gate number of a gate that the preset target object passes and vehicle passing time when passing the gate; a second obtaining unit, configured for obtaining a plurality of vehicle trajectories of the preset target object based on the plurality of vehicle passing records; a pre-processing unit, configured for performing stop point pre-processing on the vehicle trajectories to obtain pre-processed results; a third obtaining unit, configured for obtaining pre-processed records that meet a first preset condition from the pre-processed results; a clustering processing unit, configured for performing clustering processing on the pre-processed records to obtain clustering processing results; and, an outputting unit, for outputting the clustering processing results.

Optionally, the first obtaining unit of the device includes: a sorting module, configured for sorting the plurality of vehicle passing records in the order of vehicle passing time; a first obtaining module, configured for obtaining time differences between adjacent vehicle passing records; a classification module, configured for classifying the plurality of vehicle passing records based on the time differences between adjacent vehicle passing records to obtain classified trajectories, wherein, the plurality of vehicle passing records are classified into a first class of vehicle passing records and a second class of vehicle passing records, the first class of vehicle passing records are adjacent vehicle passing records extracted from the plurality of vehicle passing records whose time differences exceed a second preset time, the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records.

Optionally, the pre-processing unit of the device includes: a second obtaining module, configured for obtaining the start point and the end point of each classified trajectory in the vehicle trajectories; a counting module, configured for obtaining the number of times the start point or the end point appears in the first preset time period, wherein, the number of times that the start point or the end point appears in the first preset time period is the number of times that vehicles pass a gate corresponding to the start point or the end point; and, a third obtaining module, configured for obtaining the gate number of the gate corresponding to the start point or the end point, and the number of times that vehicles pass the gate corresponding to the start point or the end point to obtain the pre-processed results.

Optionally, the device further includes: a grouping unit, for grouping the pre-processed records based on gate number to obtain a plurality of groups of pre-processed results after obtaining pre-processed records that meet a first preset condition from the pre-processed results, wherein, the pre-processed records of the same gate number are grouped into one group, and each gate number corresponds to each group of pre-processed records respectively; an adding unit, configured for adding the numbers of times of vehicle passing corresponding to each group of pre-processed records together to obtain the total number of times of vehicle passing corresponding to each group; and, an establishing unit, configured for establishing a mapping relationship between each of the plurality of gate numbers and the total number of times of vehicle passing corresponding to each group.

Optionally, the clustering processing unit of the device is configured for performing clustering processing on the pre-processed records to obtain clustering processing results; the clustering processing unit includes: a fourth obtaining module, configured for obtaining the altitude and latitude information of the gates of the plurality of groups; and, a clustering processing module, configured for performing clustering processing on the plurality of gate numbers and the total number of times of vehicle passing corresponding to each group based on the altitude and latitude information of gates of the plurality of groups to obtain a plurality of classes of clustering processing results.

Optionally, the device further includes: a calculating unit, configured for calculating the weight of each class of clustering processing results of the plurality of classes of clustering processing results in the plurality of classes of clustering processing results, after performing clustering processing on the pre-processed records to obtain a plurality of classes of clustering processing results, wherein, the outputting unit of the device is configured for displaying the plurality of classes of clustering processing results, in combination with the weights, in different regions.

The application provides an electronic apparatus, the electronic apparatus includes: a housing, a processor, a memory, a circuit board, and a power source circuit, wherein, the circuit board is arranged inside the space enclosed by the housing, with the processor and the memory provided on the circuit board; the power source circuit is configured for powering various circuits or components of the electronic device; the memory is configured for storing an executable program; the processor implements the described method of processing vehicle passing records by executing the executable program stored in the memory.

The application further provides an executable program for implementing the described method of processing vehicle passing records when being executed.

The application further provides a storage medium for storing an executable program, the executable program is configured to implement the described method of processing vehicle passing records when being executed.

In the application, a plurality of vehicle passing records of a preset target object during a first preset time period are obtained, wherein, each of the vehicle passing records includes a gate number of a gate that the preset target object passes and vehicle passing time when passing the gate; a plurality of vehicle trajectories of the preset target object are obtained based on the plurality of vehicle passing records; stop point pre-processing of the vehicle trajectories is performed to obtain pre-processed results; pre-processed records that meet a first preset condition are obtained from the pre-processed results; then, clustering processing of the pre-processed records is performed to obtain clustering processing results; and finally, the clustering processing results are outputted. This solves the problem of inaccurate stop point analysis and thus increases the accuracy of stop point analysis.

DESCRIPTION OF THE ACCOMPANYING DRAWINGS

The drawings which are a part of the present application are used to provide understandings to the present application, and the exemplary embodiments of the present application and the description thereof are used to interpret the present application, which does not constitute inappropriate limitation of the present application. In the drawings.

DETAILED DESCRIPTION OF THE INVENTION

Figure 1:
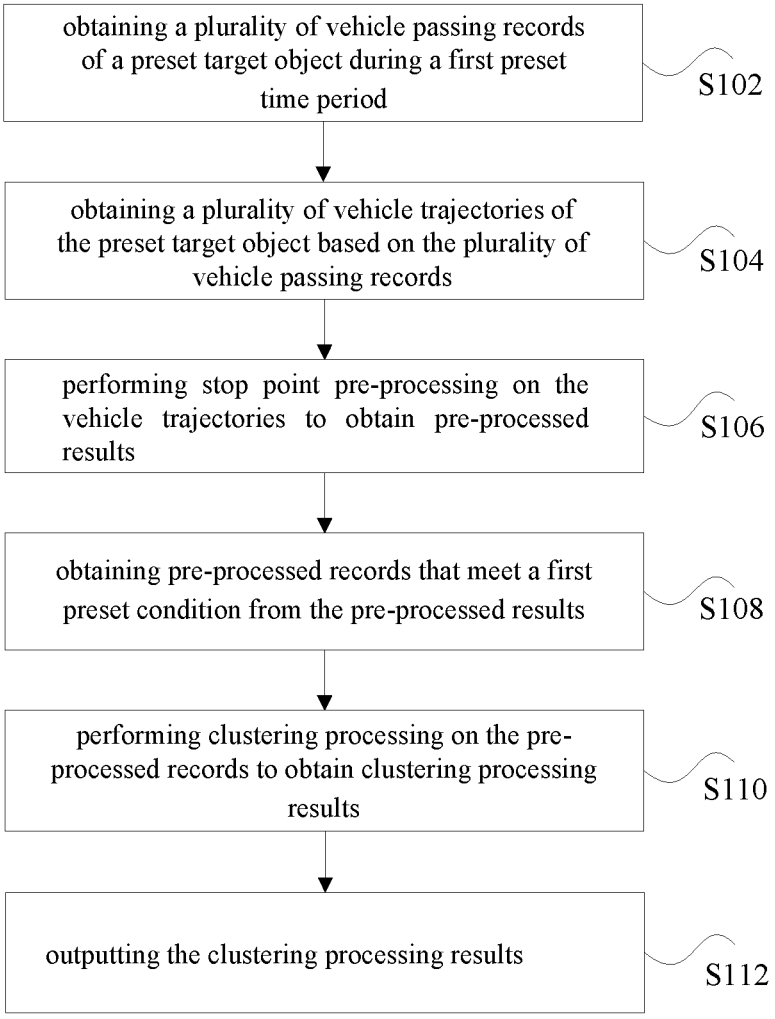
FIG. 1 is a flow chart of a method of processing vehicle passing records according to a first embodiment of the application.

It should be noted that the embodiments and the features in the embodiments of the present invention can be combined in the case that there is no conflicts. The present application will be described below in combination of the embodiments and by reference to the drawings.

In order for those skilled in the art to better understand the solution of the present application, the technical solutions of the embodiments of the present application will be clearly and completely described below in conjunction with the accompanying drawings of the embodiments of the present application. Obviously, the described embodiments are merely some embodiments of the present application, rather than all the embodiments. All other embodiments obtained based on the embodiments of the present application by those ordinary persons skilled in the art without any creative efforts fall into the scope of protection of the present application.

It should be noted that the terms "first", "second" and the like in the description and claims and the foregoing drawings of the present application are only used to distinguish similar objects, and are not necessarily used to describe a particular order or sequence. It should be understood that the data used in this way can be interchangeable in appropriate situations, so as to describe the embodiments of the present application. Moreover, the terms such as "comprise", "contain" or any variants thereof are intended to cover a non-exclusive inclusion, for example, a process, method, system, product, or device that incorporates a series of steps or units need not be limited to those steps or units explicitly listed, but may include other steps or units not expressly listed or inherent to these processes, methods, products or devices.

First, the technical terms involved in the embodiments are explained as follows:

Stop point analysis: when the coverage rate of a gate point reaches a certain degree, based on the vehicle trajectory of a suspect vehicle appearing in a gate system, the locations at which the vehicle appears during a designated time period can be analyzed, and the stop points of the suspect vehicle can be analyzed.

Clustering: the process of classifying and organizing data elements of data that are mainly similar in a certain aspect; clustering is a technique that discovers such an internal structure, and clustering technology is often called unsupervised learning.

K-means clustering algorithm: a K-means algorithm is a hard clustering algorithm, and a classic representative of a prototype-based objective function clustering method; it uses a certain type of distance from a data point to a prototype as an optimal objective function, and obtains adjustment rules of iteration calculations using the method of calculating extremum of a function. The K-means algorithm uses the Euclidean distance as the criterion to measure similarity. It consists in obtaining the optimal classification of vectors V corresponding to a certain initial cluster center to minimize an evaluation index J. The algorithm uses an error sum squares criterion function as the clustering criterion function.

Vehicle trajectory: a trajectory refers to an ordered set sorted in the chronological order of vehicle passing records of a vehicle license plate during a time period, with two adjacent vehicle passing records whose time differences exceed a preset time period being classified as two trajectories.

Embodiments of the application provide a method of processing vehicle passing records.

FIG. 1 is a flow chart of a method of processing vehicle passing records according to a first embodiment of the application. As shown in FIG. 1, the method of processing vehicle passing records includes the following steps:

Step S102: obtaining a plurality of vehicle passing records of a preset target object during a first preset time period.

After a preset target object has stopped, e.g., after a vehicle of a designated vehicle license plate has stopped, the locations at which the vehicle stops during a designated time period are analyzed. Optionally, in a gate system, the locations at which a vehicle stops are analyzed via the coverage rates of gates of a vehicle during a designated time period, i.e., the vehicle trajectories of the vehicle that passes the gates during the designated time period.

There are different vehicle passing records when a preset target object passes different gates during different time periods, wherein, each of the vehicle passing records contains a gate number of a gate that the preset target object passes and vehicle passing time when passing the gate. For example, during a first preset time period that is the time period from 6 o'clock to 12 o'clock, the vehicle passing records of a preset target object are: passing Card Gate No. 1 at 6 o'clock, passing Card Gate No. 2 at 7 o'clock, passing Card Gate No. 3 at 9 o'clock, passing Card Gate No. 4 at 10 o'clock, and passing Card Gate No. 5 at 12 o'clock.

After obtaining a plurality of vehicle passing records of a preset target object during a first preset time period, the plurality of vehicle passing records are sorted based on the vehicle passing time of the preset target object, and then the time differences between adjacent vehicle passing records are obtained based on the vehicle passing time of the preset target object.

For example, the preset target object passes Card Gate No. 1 at 6 o'clock and Card Gate No. 2 at 7 o'clock, with the time difference between Card Gate No. 1 and Card Gate No. 2 being 1 hour; the preset target object passes Card Gate No. 2 at 7 o'clock and Card Gate No. 3 at 9 o'clock, with the time difference between Card Gate No. 2 and Card Gate No. 3 being 2 hours; the preset target object passes Card Gate No. 3 at 9 o'clock and Card Gate No. 4 at 10 o'clock, with the time difference between Card Gate No. 3 and Card Gate No. 4 being 1 hour; the preset target object passes Card Gate No. 4 at 10 o'clock and Card Gate No. 5 at 12 o'clock, with the time difference between Card Gate No. 4 and Card Gate No. 5 being 2 hours.

After obtaining the time differences between adjacent vehicle passing records based on the vehicle passing time of the preset target object, the plurality of vehicle passing records are classified to obtain classified trajectories. In an embodiment of the application, the plurality of vehicle passing records are classified based on a second preset time, wherein, the plurality of vehicle passing records are classified into a first class of vehicle passing records and a second class of vehicle passing records, the first class of vehicle passing records being adjacent vehicle passing records extracted from the plurality of vehicle passing records whose time differences exceed the second preset time, the second class of vehicle passing records being adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records. The first vehicle passing record is the start point of the first classified trajectory, and the last vehicle passing record is the end point of the last classified trajectory.

For example, the second preset time is 1.5 hours, the passing of the preset target object of Card Gate No. 1 at 6 o'clock and Card Gate No. 2 at 7 o'clock is the second class of vehicle passing record, the passing of the preset target object of Card Gate No. 2 at 7 o'clock and Card Gate No. 3 at 9 o'clock is the first class of vehicle passing record, the passing of the preset target object of Card Gate No. 3 at 9 o'clock and Card Gate No. 4 at 10 o'clock is the second class of vehicle passing record, and the passing of the preset target object of Card Gate No. 4 at 10 o'clock and Card Gate No. 5 at 12 o'clock is the first class of vehicle passing record. Thus, the passing of Card Gate No. 1 at 6 o'clock and Card Gate No. 2 at 7 o'clock is a classified trajectory, and the passing of Card Gate No. 3 at 9 o'clock, Card Gate No. 4 at 10 o'clock, and Card Gate No. 5 at 12 o'clock is another classified trajectory.

Here, the passing of Card Gate No. 5 at 12 o'clock is the last vehicle passing record. Therefore, the passing of Card Gate No. 3 at 9 o'clock, Card Gate No. 4 at 10 o'clock, and Card Gate No. 5 at 12 o'clock is another classified trajectory Here, a classified trajectory can be understood as a vehicle trajectory.

Step S104: obtaining a plurality of vehicle trajectories of the preset target object based on the plurality of vehicle passing records.

After obtaining a plurality of vehicle passing records of the preset target object during a first preset time period, a plurality of vehicle trajectories of the preset target object are obtained based on the plurality of vehicle passing records, i.e., an ordered set sorted in the chronological order of vehicle passing records of a vehicle license plate during a time period is obtained, which is classified into two trajectories if the time difference between two adjacent vehicle passing records exceeds a preset time.

After obtaining a plurality of vehicle passing records of a preset target object during a first preset time period, the plurality of vehicle passing records are sorted in the order of vehicle passing time of the preset target object, and then the time differences between adjacent vehicle passing records are obtained based on the vehicle passing time of the preset target object.

For example, with the present target object passing Card Gate No. 1 at 6 o'clock and Card Gate No. 2 at 7 o'clock, the time difference between Card Gate No. 1 and Card Gate No. 2 is 1 hour; with the present target object passing Card Gate No. 2 at 7 o'clock and Card Gate No. 3 at 9 o'clock, the time difference between Card Gate No. 2 and Card Gate No. 3 is 2 hours; with the present target object passing Card Gate No. 3 at 9 o'clock and Card Gate No. 4 at 10 o'clock, the time difference between Card Gate No. 3 and Card Gate No. 4 is 1 hour; and, with the present target object passing Card Gate No. 4 at 10 o'clock and Card Gate No. 5 at 12 o'clock, the time difference between Card Gate No. 4 and Card Gate No. 5 is 2 hours.

After obtaining the time differences between adjacent vehicle passing records based on the vehicle passing time of the preset target object, the plurality of vehicle passing records are classified to obtain classified trajectories.

Step S106: performing stop point pre-processing on the vehicle trajectories to obtain pre-processed results.

A stop point is a location that the preset target object has not left for the second preset time after having stopped. After obtaining vehicle trajectories of the preset target object, stop point pre-processing is performed on the vehicle trajectories. The start point and the end point of each classified trajectory in the vehicle trajectories are obtained; the number of times the start point or the end point of each classified trajectory appears in the first preset time period is obtained, i.e., the number of times of vehicle passing the gate corresponding to the start point or the end point of each classified trajectory is obtained; finally, the gate number and number of times of vehicle passing corresponding to the start point or the end point of each classified trajectory are obtained to obtain the pre-processed results.

For example, during a preset time period that is the time period from 6 o'clock to 12 o'clock, the start point of the classified trajectory of passing of Card Gate No. 1 at 6 o'clock and Card Gate No. 2 at 7 o'clock is the passing of Card Gate No. 1 at 6 o'clock, and its end point is the passing of Card Gate No. 2 at 7 o'clock. The start point of the classified trajectory of passing of Card Gate No. 3 at 9 o'clock, Card Gate No. 4 at 10 o'clock, and Card Gate No. 5 at 12 o'clock is the passing of Card Gate No. 3 at 9 o'clock, and its end point is the passing of Card Gate No. 5 at 12 o'clock. The gate number and number of times of vehicle passing corresponding to the start point or the end point of each classified trajectory are obtained to obtain the pre-processed results that are: Card Gate No. 1 being passed at 6 o'clock, and its number of times of vehicle passing being 1; Card Gate No. 2 being passed at 7 o'clock, and its number of times of vehicle passing being 1; Card Gate No. 3 being passed at 9 o'clock, and its number of times of vehicle passing being 1; Card Gate No. 5 being passed at 12 o'clock, and its number of times of vehicle passing being 1.

Step S108: obtaining pre-processed records that meet a first preset condition from the pre-processed results.

The vehicles trajectories of a plurality of preset target objects during a plurality of preset time periods and the pre-processed results during a plurality of preset time periods can be obtained. For example, the vehicle trajectories of a preset target object during the period from Jan. 1, 2015 to Jun. 30, 2015 are obtained, and a plurality of pre-processed results of the preset target object during the period from Jan. 1, 2015 to Jun. 30, 2015 are obtained. After obtaining pre-processed records that meet a first preset condition from the pre-processed results, optionally, the first preset condition can be vehicle license plate number and the starting and ending dates. First, the plurality of pre-processed results are grouped based on gate number, with those having the same gate number being in the same group, thus obtaining a plurality of groups of different gate numbers, each containing respectively the pre-processed records corresponding to a gate number. Then, the numbers of times of vehicle passing corresponding to the pre-processed records of the plurality of groups are added together to obtain the total number of times of vehicle passing corresponding to each group. Finally, a mapping relationship between the plurality of gate numbers and the total number of times of vehicle passing corresponding to each group is established to obtain a set composed of each gate number and the total number of times of vehicle passing corresponding to the gate number.

For example, the vehicle trajectories during the period from Jan. 1, 2015 to Jan. 3, 2015 are, respectively: passing Card Gate No. 1 at 6 o'clock, with the number of times of vehicle passing being 1, passing Card Gate No. 2 at 7 o'clock, with the number of times of vehicle passing being 1, passing Card Gate No. 3 at 9 o'clock, with the number of times of vehicle passing being 1, and passing Card Gate No. 5 at 12 o'clock, with the number of times of vehicle passing being 1; passing Card Gate No. 1 at 6 o'clock, with the number of times of vehicle passing being 2, passing Card Gate No. 2 at 7 o'clock, with the number of times of vehicle passing being 1, passing Card Gate No. 3 at 9 o'clock, with the number of times of vehicle passing being 3, and passing Card Gate No. 5 at 12 o'clock, with the number of times of vehicle passing being 2; passing Card Gate No. 1 at 6 o'clock, with the number of times of vehicle passing being 2, passing Card Gate No. 2 at 7 o'clock, with the number of times of vehicle passing being 1, passing Card Gate No. 3 at 9 o'clock, with the number of times of vehicle passing being 3, and passing Card Gate No. 5 at 12 o'clock, with the number of times of vehicle passing being 2. Therefore, Card Gates No. 1, Card Gates No. 2, Card Gates No. 3, Card Gates No. 4, and Card Gates No. 5 correspond respectively to 5 groups, the total number of times of vehicle passing of the first group being the sum of all the numbers of times of vehicle passing of Card Gate No. 1 and equal to 1+2+2=5 times, the total number of times of vehicle passing of the second group being the sum of all the numbers of times of vehicle passing of Card Gate No. 2 and equal to 1+1+1=3 times, the total number of times of vehicle passing of the third group being the sum of all the numbers of times of vehicle passing of Card Gate No. 3 and equal to 1+3+3=7 times, the total number of times of vehicle passing of the fourth group being the sum of all the numbers of times of vehicle passing of Card Gate No. 5 and equal to 1+2+2=5 times. A mapping relationship in which Card Gate No. 1 corresponds to 5 times, Card Gate No. 2 corresponds to 3 times, Card Gate No. 3 corresponds to 7 times, and Card Gate No. 5 corresponds to 5 times can be obtained, each gate number, the number of times of vehicle passing corresponding to the gate number, and the gate being the elements forming the set.

Step S110: performing clustering processing on the pre-processed records to obtain clustering processing results.

The pre-processed records that meet a first preset condition are obtained from the pre-processed results. A set formed by each gate number and the total number of times of vehicle passing corresponding to the gate number can be obtained. There exist data members similar in certain aspects among the elements of the set. For example, the similarity in terms of location information between the elements formed by each gate number, the number of times of vehicle passing corresponding to the gate number, and the gate is sorted and organized. Clustering processing can be used to discover similar structures for sorting and organizing. In one embodiment of the application, the K-means clustering algorithm is used to achieve clustering processing of pre-processing records, reducing the amount of data calculation after the pre-processing.

Performing clustering processing on the pre-processed records includes: based on the mapping relationship, performing clustering processing on the plurality of gate numbers and the total number of times of vehicle passing corresponding to each group. First, the altitude and latitude information of gates of the plurality of groups is obtained. Clustering processing is performed on the plurality of gate numbers and the total number of times of vehicle passing corresponding to each group based on the altitude and latitude information of gates of the plurality of groups to obtain a plurality of classes of clustering processing results. For example, the plurality of classes of clustering processing results are classified based on the location and distance, with the gates that are near to a certain degree being classified into one class, said class corresponding to one region.

Step S112: outputting the clustering processing results.

After performing clustering processing on the pre-processed records to obtain a plurality of classes of clustering processing results, the weight of each class of clustering processing results in the plurality of classes of clustering processing results is calculated, wherein, outputting the clustering processing results includes: displaying the plurality of classes of clustering processing results, in combination with the weights, in different regions, in order to analyze the performance of each class of clustering processing results in the overall clustering processing results, improving real time analysis performance.

Optionally, the clustering processing results are displayed on a map; the set corresponding to the gates of one cluster is taken as one region, and displayed in different colors on the map based on the weight of each class, from light color to dark color, which can represent the change of weight from small to big.

It is worth to note that the word "a plurality of" in the application can be understood as "at least two".

The embodiment, by obtaining a plurality of vehicle passing records of a preset target object during a first preset time period, obtaining a plurality of vehicle trajectories of the preset target object, performing stop point pre-processing on the vehicle trajectories to obtain pre-processed results, then obtaining pre-processed records that meet a first preset condition from the pre-processed results, performing clustering processing on the pre-processed records to obtain clustering processing results, and finally, outputting the clustering processing results, which reduces the quantity of data calculation after the pre-processing, and thus gets the results of stop point analysis more rapidly, increases the accuracy of stop point analysis and improves the real time analysis performance of vehicle stop point analysis.

Figure 2:
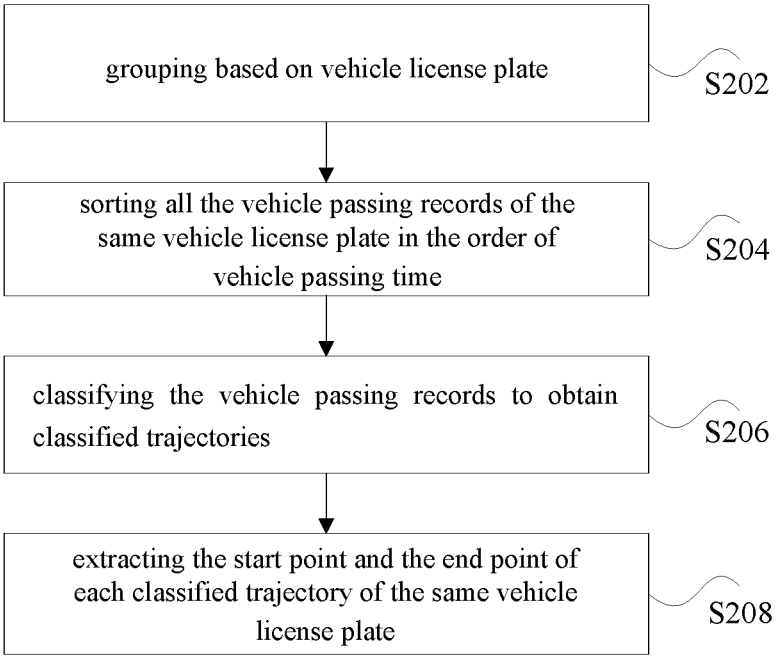
FIG. 2 is a flow chart of a method of processing vehicle passing records according to a second embodiment of the application.

FIG. 2 is the flow chart of a method of processing vehicle passing records according to a second embodiment of the application. It should be noted that, the method of processing vehicle passing records includes vehicle trajectory analysis. As shown in FIG. 2, the method of processing vehicle passing records includes the following steps:

Step S202: grouping a plurality of preset target objects.

A plurality of vehicle passing records of a plurality of preset target objects during a preset time period are obtained, and grouped based on the vehicle license plates of the plurality of preset target objects, then performed distributed parallel computing, i.e., vehicle trajectory analysis can be done simultaneously on the plurality of target objects. All the vehicle passing records, containing gate number of a gate that a preset target object passes and vehicle passing time when passing the gate, of the same vehicle license plate are obtained.

Step S204: sorting all the vehicle passing records of the same vehicle license plate in the order of vehicle passing time.

Vehicle passing records contain gate number of a gate that a preset target object passes and vehicle passing time when passing the gate. A plurality of vehicle passing records of a preset target object are sorted in the order of vehicle passing time, e.g., the vehicle passing records are sorted in a clockwise order.

Step S206: classifying the vehicle passing records to obtain classified trajectories.

After sorting all the vehicle passing records of the same vehicle license plate in the order of vehicle passing time, a trajectory idea is used, i.e., the start and end points of a trajectory correspond to the vehicle passing records of the gate closest to the stop point. A mapping relationship between gate number and number of times of vehicle passing is obtained through analysis based on the vehicle license plate of the preset target object to obtain a set of trajectories of the preset target object. A plurality of vehicle passing records can be classified by a second preset time, wherein, the plurality of vehicle passing records are classified into a first class of vehicle passing records and a second class of vehicle passing records, in which the first class of vehicle passing records are adjacent vehicle passing records extracted from the plurality of vehicle passing records whose time differences exceed a second preset time, and the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records. The first vehicle passing record is the start point of the first classified trajectory, and the last vehicle passing record is the end point of the last classified trajectory.

Figure 3:
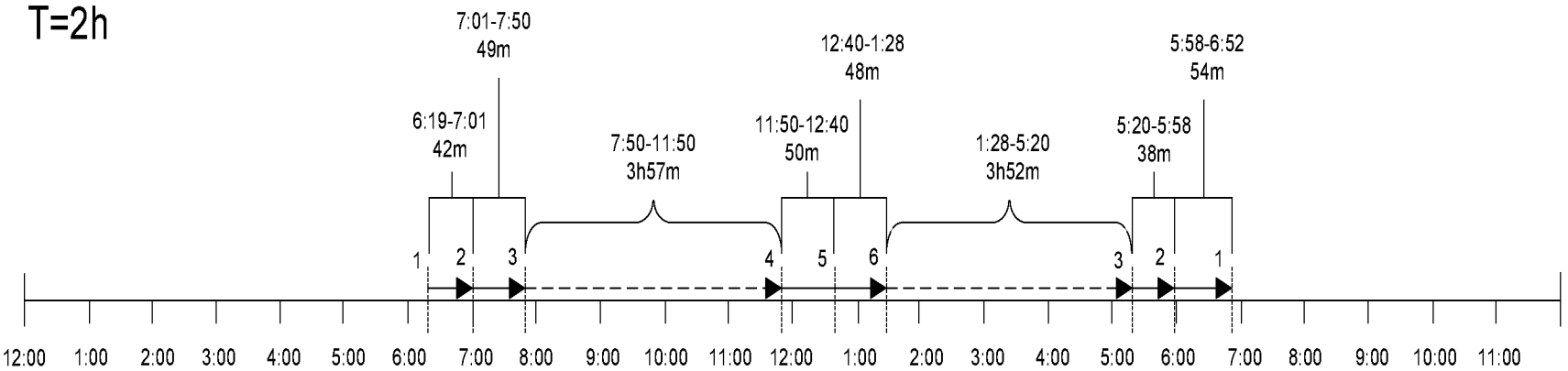
FIG. 3 is a schematic view of vehicle trajectory analysis according to an embodiment of the application.

Vehicle trajectories of a preset target object are analyzed by classifying vehicle passing records. FIG. 3 is a schematic view of vehicle trajectory analysis according to an embodiment of the application. As shown in FIG. 3, vehicle trajectories of a vehicle with the license plate number of ZheA8888 are analyzed. A first preset time period is the 24-hour time period starting from 12 o'clock, a second preset time period is T=2 h, in which the axis represents the time during a day, the time at which a preset target object passes a gate shows above the axis. The vehicle with the license plate number of ZheA8888 passes Card Gate No. 1, No. 2, No. 3, No. 4, and No. 5 during 24 hours. The time differences between adjacent vehicle passing records of ZheA8888 are calculated. If the time difference exceeds T=2 h, then the former vehicle passing record in the adjacent vehicle passing records is taken as the end point of the previous classified trajectory, and the latter vehicle passing record in the adjacent vehicle passing records is taken as the start point of the next classified trajectory, thus obtaining all the trajectories of the vehicle license plate. The vehicle of ZheA8888 passes Card Gate No. 1 at 6:19 and Card Gate No. 2 at 7:01, so on and so forth. With the time interval of classifying trajectories defined as 2 hours, ultimately, there are 3 classified trajectories during the day, which are respectively: a trajectory formed by Card Gate No. 1, Card Gate No. 2, and Card Gate No. 3, a trajectory formed by Card Gate No. 4, Card Gate No. 5, and Card Gate No. 6, and a trajectory formed by Card Gate No. 3, Card Gate No. 2, and Card Gate No. 1.

Step S208: extracting the start point and the end point of each classified trajectory of the same vehicle license plate.

The start point and the end point of each classified trajectory of the same vehicle license plate are extracted. The gate number and the time of the vehicle passing record are read. The total number of times the start point or the end point of each vehicle trajectory appears is obtained based on the date and the gate number, i.e., the total number of times of the start point or the end point of each vehicle trajectory. For example, the obtaining results in S206 are: [Vehicle license plate: ZheA8888, Date: 2015, Jan. 1, { Card Gate: No. 1, Number of times: 2}, { Card Gate: No. 3, Number of times: 2}, { Card Gate: No. 4, Number of times: 1}, { Card Gate: No. 6, Number of times: 1}], achieving pre-processing of stop points.

S202, S204, S206, and S208 described above can be understood as an implementation of S106.

The embodiment groups a plurality of preset target objects, sorts all the vehicle passing records of the same vehicle license plate in the order of vehicle passing time, then classifies the vehicle passing records to obtain classified trajectories, then extracts the start point and the end point of each classified trajectory of the same vehicle license plate, and performs pre-processing on stop points, achieving vehicle trajectory analysis and pre-processing of stop points.

Figure 4:
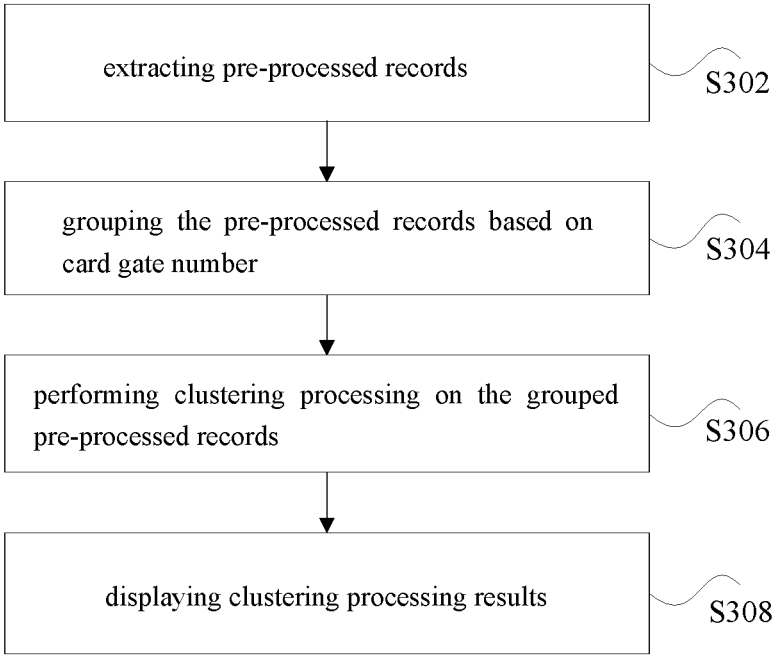
FIG. 4 is a flow chart of a method of processing vehicle passing records according to a third embodiment of the application.

FIG. 4 is the flow chart of a method of processing vehicle passing records according to a third embodiment of the application. It should be noted, the method of processing vehicle passing records includes stop point analysis. As shown in FIG. 4, the method of processing vehicle passing records includes the following steps:

Step S302: extracting pre-processed records.

After analyzing vehicle trajectories of a preset target object and pre-processing stop points of the preset target object, a user analyzes the stop points of the preset target object during a first preset time period. A first preset condition is set to be the starting and ending dates and a vehicle license plate number. Stop points of a plurality of preset target objects are analyzed simultaneously based on the first preset condition using a distributed computing engine. During the first preset time period, pre-processed records of all dates that meet the first preset condition are found from the pre-processed results.

Step S304: grouping the pre-processed records based on gate number.

Figure 5:
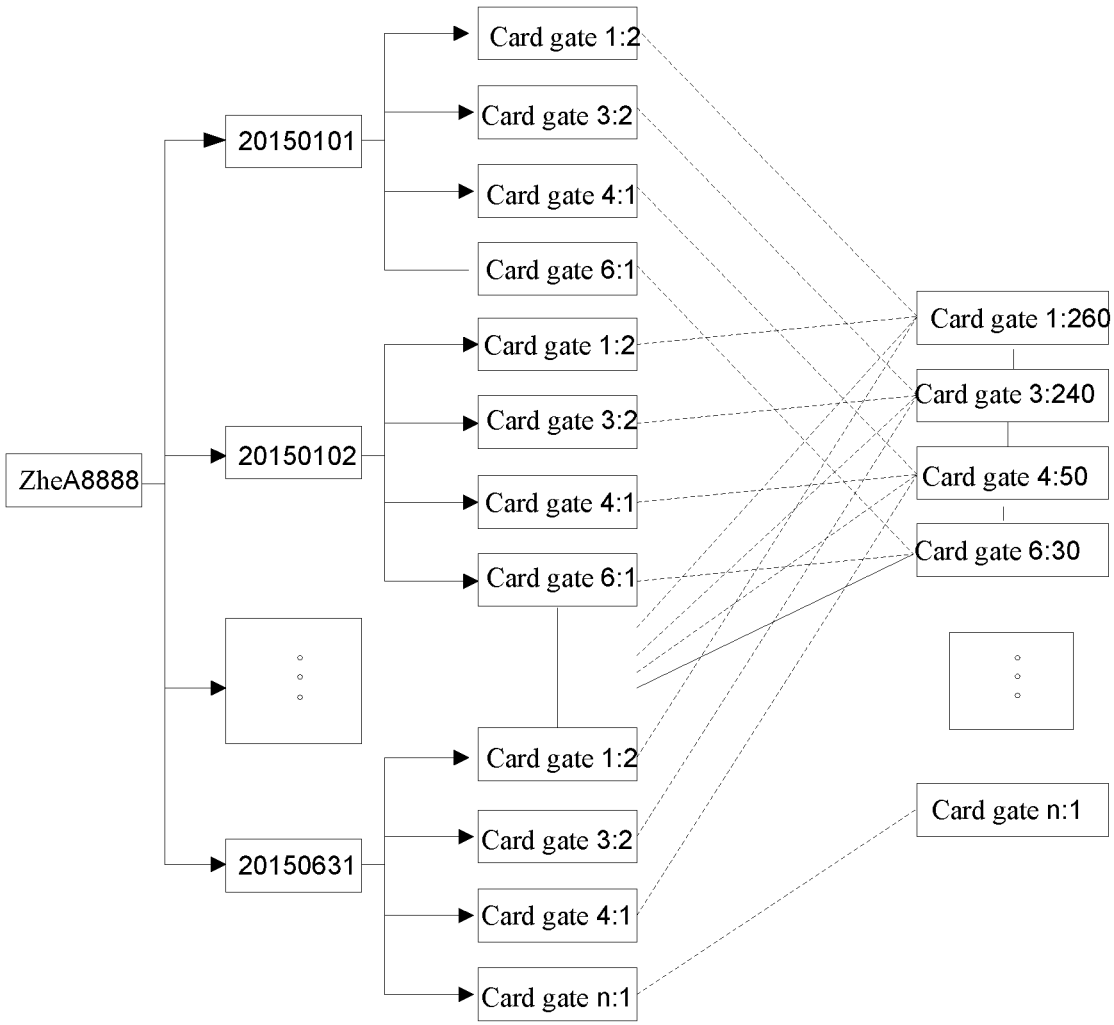
FIG. 5 is a schematic view of obtaining stop points based on gate according to an embodiment of the application.

FIG. 5 is a schematic view of courting stop points based on gate according to embodiments of the application. As shown in FIG. 5, the preset target object is a vehicle with the vehicle license plate number of ZheA8888. Pre-processed records of the same gate number in the pre-processed records during a first preset time period from Jan. 1, 2015 to Jun. 31, 2015 are grouped into one group, and a plurality of groups of pre-processed records are obtained. For example, the results of grouping are 1~n groups, the 1~n groups corresponding to, respectively, a corresponding gate number, and n gate numbers corresponding to, respectively, the 1~n groups of pre-processed records. After grouping based on gate number, the total numbers of times of vehicle passing of the same gate number during the period from Jan. 1, 2015 to Jun. 31, 2015 are added together, to obtain the total number of times of vehicle passing corresponding to, respectively, each group. For example, it is 260 times for Card Gate No. 1, 240 times for Card Gate No. 3, 50 times for Card Gate No. 4, 30 times for Card Gate No. 6, and 1 time for Card Gate No. n. Finally, a mapping relationship between a plurality of gate numbers and the total number of times of vehicle passing corresponding to each group is established, and a set of [gate number, total number of times of vehicle passing] can be obtained.

Step S306: performing clustering processing on the grouped pre-processed records.

Performing clustering processing on the grouped pre-processed records includes performing clustering processing on a plurality of gate numbers and the total number of times of vehicle passing corresponding to each group based on the mapping relationship; in combination with the altitude and latitude information of gates of a plurality of groups, performing clustering processing on a plurality of gate numbers and the total number of times of vehicle passing corresponding to each group based on the altitude and latitude information of the gates of the plurality of groups. In one embodiment of the application, the K-means clustering algorithm is used to obtain N classes to obtain a plurality of classes of clustering processing results. Each class is a subset of the set of gate and total number of times of vehicle passing in Step S304. For example, the plurality of classes of clustering processing results are classified based on the nearness of the location, with gates that are near to a certain degree being one class, said class corresponding to one region. At the same time, the weight of each class of clustering processing results in the plurality of classes of clustering processing results is calculated to obtain the weights of specific classes of clustering processing results in all the stop points.

S302, S304, and S306 described above can be understood as a mode of realization of S110.

Step S308: displaying clustering processing results.

Clustering processing results are displayed on a map, with the set of one class of cluster [gate number, total number of times of vehicle passing] being one region. A plurality of classes of clustering processing results are displayed, in combination with weights, in different regions, and displayed in different colors based on the different weights on the map, from light color to dark color, which can represent the change of weight from small to big.

S308 described above can achieve the same technical effect as S112

The embodiment extracts pre-processed records, then groups the pre-processed records based on gate number, then performs clustering processing on the grouped pre-processed records, and finally displays clustering processing results, which reduces the quantity of data calculation after the pre-processing, and thus gets the results of stop point analysis more rapidly, increases the accuracy of stop point analysis and improves the real time analysis performance of vehicle stop point analysis.

It should be noted, the steps illustrated in the flow charts of the accompanying drawings can be executed in a computer system of, e.g., a set of computer executable instructions, and, although a logical order is shown in the flow charts, the steps shown or described can be executed in an order different from here in certain situations.

Embodiments of the application further provide a device of processing vehicle passing records. It should be noted that the device of processing vehicle passing records of the embodiments of the application can be used to execute the method of processing vehicle passing records of the embodiments of the application.

Figure 6:
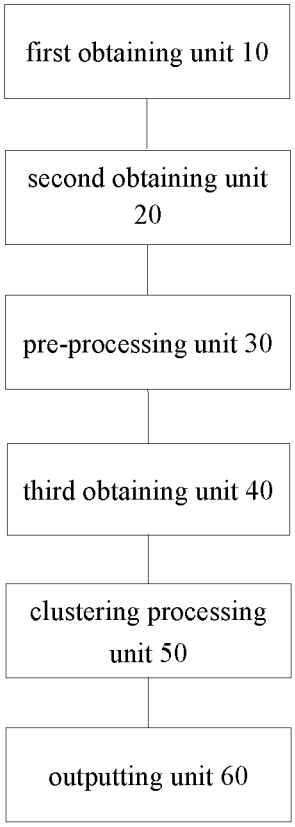
FIG. 6 is a schematic view of a device of processing vehicle passing records according to a first embodiment of the application.

FIG. 6 is a schematic view of a device of processing vehicle passing records according to a first embodiment of the application. As shown by FIG. 6, the device includes: a first obtaining unit 10, a second obtaining unit 20, a pre-processing unit 30, a third obtaining unit 40, a clustering processing unit 50, and an outputting unit 60.

The first obtaining unit 10 is configured for obtaining a plurality of vehicle passing records of a preset target object during a first preset time period, wherein, each of the vehicle passing records includes a gate number of a gate that the preset target object passes and vehicle passing time when passing the gate;

The second obtaining unit 20 is configured for obtaining a plurality of vehicle trajectories of the preset target object based on the plurality of vehicle passing records. After the first obtaining unit 10 has obtained a plurality of vehicle passing records of a preset target object during a first preset time period, the second obtaining unit 20 obtains a plurality of vehicle trajectories of the preset target object based on the plurality of vehicle passing records, i.e., obtains an ordered set of the vehicle passing records of a vehicle license plate during a time period sorted chronologically, which are classified into two trajectories if the time difference between two adjacent vehicle passing records exceeds a preset time.

The pre-processing unit 30 is configured for performing stop point pre-processing on the vehicle trajectories to obtain pre-processed results. A stop point is a location that the preset target object remains without leaving for a second preset time after having stopped. After the vehicle trajectories of the preset target object are obtained, the pre-processing unit 30 performs stop point pre-processing on the vehicle trajectories. The start point and the end point of each classified trajectory in the vehicle trajectories are obtained; the number of times the start point or the end point of each classified trajectory appears in the first preset time period is obtained, i.e., the number of times of vehicle passing of the gate corresponding to the start point or the end point of each classified trajectory is obtained; finally, the gate number and number of times of vehicle passing corresponding to the start point or the end point of each classified trajectory are obtained to obtain the pre-processed results.

The third obtaining unit 40 is configured for obtaining pre-processed records that meet a first preset condition from the pre-processed results. The vehicle trajectories of a plurality of preset target objects during a plurality of time periods and the pre-processed results during the plurality of preset time periods can be obtained. First, the pre-processed records in the plurality of pre-processed results are grouped based on gate number, with those having the same gate number being in the same group, thus obtaining a plurality of groups of different gate numbers, each containing respectively the pre-processed records corresponding to a gate number. Then, the numbers of times of vehicle passing corresponding to the pre-processed records of the plurality of groups are added together to obtain the total number of times of vehicle passing of each group. Finally, a mapping relationship between the plurality of gate numbers and the total number of times of vehicle passing corresponding to each group is established, respectively, thus the third obtaining unit 40 obtains pre-processed records that meet a first preset condition.

The clustering processing unit 50 is configured for performing clustering processing on the pre-processed records to obtain clustering processing results. The third obtaining unit 40 obtains pre-processed records that meet a first preset condition from the pre-processed results. A set formed by each gate number and the total number of times of vehicle passing corresponding to the gate number is obtained. There exist data members similar in certain aspects among the elements of the set. For example, the similarity in terms of location information between the elements formed by each gate number, the number of times of vehicle passing corresponding to that gate number, and the gate is sorted and organized. The clustering processing unit 50 discovers similar structures for sorting and organizing through clustering processing. In one embodiment of the application, the clustering processing unit 50 uses a K-means clustering algorithm to perform clustering processing on pre-processed records.

Performing clustering processing on the pre-processed records includes: based on the mapping relationship, performing clustering processing on the plurality of gate numbers and the total number of times of vehicle passing corresponding to each group. First, the altitude and latitude information of gates of the plurality of groups is obtained. Clustering processing is performed on the plurality of gate numbers and the total number of times of vehicle passing corresponding to each group based on the altitude and latitude information of the gates of the plurality of groups to obtain a plurality of classes of clustering processing results. For example, the plurality of classes of clustering processing results are classified based on the nearness of the location, with the gates that are near to a certain degree being classified into one class, said class corresponding to one region.

The outputting unit 60 is configured for outputting the clustering processing results. After the clustering processing unit 50 has performed clustering processing on the pre-processed records to obtain a plurality of classes of clustering processing results, the weight of each class of clustering processing results in the plurality of classes of clustering processing results is calculated, and the outputting unit 60 displays the plurality of classes of clustering processing results, in combination with the weights, in different regions.

Figure 7:
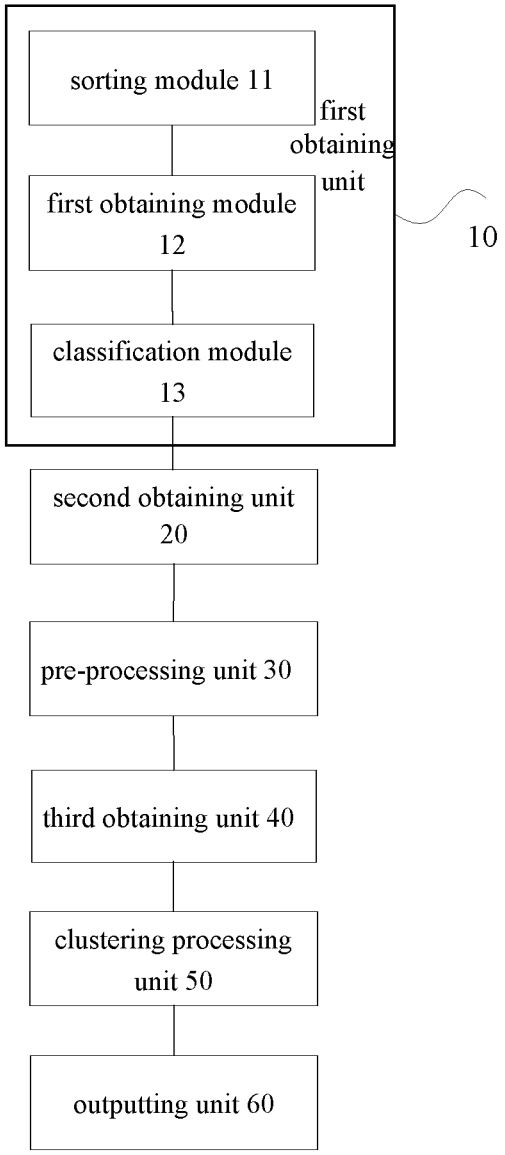
FIG. 7 is a schematic view of a device of processing vehicle passing records according to a second embodiment of the application.

FIG. 7 is a schematic view of a device of processing vehicle passing records according to a second embodiment of the application. As shown in FIG. 7, the device includes: a first obtaining unit 10, a pre-processing unit 30, a second obtaining unit 20, a third obtaining unit 40, a clustering processing unit 50, and an outputting unit 60, wherein, the first obtaining unit 10 includes a sorting module 11, a first obtaining module 12, and a classification module 13.

The functions of the first obtaining unit 10, the pre-processing unit 30, the second obtaining unit 20, the third obtaining unit 40, the clustering processing unit 50, and the outputting unit 60 in the embodiment are the same as in the device of processing vehicle passing records of the second embodiment of the application.

The sorting module 11 is configured for sorting the plurality of vehicle passing records in the order of vehicle passing time. After obtaining a plurality of vehicle passing records of a preset target object during a first time period, the sorting module 11 sorts the plurality of vehicle passing records in the order of vehicle passing time of the preset target object.

The first obtaining module 12 is configured for obtaining the time differences between adjacent vehicle passing records. Specifically, the first obtaining module 12 obtains the time differences between adjacent vehicle passing records based on the vehicle passing time of the preset target object.

The classification module 13 is configured for classifying the plurality of vehicle passing records to obtain classified trajectories. After time differences between adjacent vehicle passing records are obtained by the first obtaining module 12 based on the vehicle passing time of the preset target object, the classification module 13 classifies the plurality of vehicle passing records to obtain classified trajectories. In one embodiment of the application, the plurality of vehicle passing records can be classified based on a second preset time, wherein, the plurality of vehicle passing records are classified into a first class of vehicle passing records and a second class of vehicle passing records, in which the first class of vehicle passing records are adjacent vehicle passing records extracted from the plurality of vehicle passing records whose time differences exceed a second preset time, and the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records. The first vehicle passing record is the start point of the first classified trajectory, and the last vehicle passing record is the end point of the last classified trajectory.

In an embodiment of the application, the second obtaining unit 20 includes a sorting module, a first obtaining module, and a classification module.

The sorting module is configured for sorting the plurality of vehicle passing records in the order of vehicle passing time. After obtaining a plurality of vehicle passing records of a preset target object during a first time period, the sorting module sorts the plurality of vehicle passing records in the order of vehicle passing time of the preset target object.

The first obtaining module is configured for obtaining the time differences between adjacent vehicle passing records. Specifically, the first obtaining module obtains the time differences between adjacent vehicle passing records based on the vehicle passing time of the preset target object.

The classification module is configured for classifying the plurality of vehicle passing records to obtain classified trajectories. After time differences between adjacent vehicle passing records are obtained by the first obtaining module based on the vehicle passing time of the preset target object, the classification module classifies the plurality of vehicle passing records to obtain classified trajectories. In an embodiment of the application, the plurality of vehicle passing records can be classified based on a second preset time, wherein, the plurality of vehicle passing records are classified into a first class of vehicle passing records and a second class of vehicle passing records, in which the first class of vehicle passing records are adjacent vehicle passing records extracted from the plurality of vehicle passing records whose time differences exceed a second preset time, and the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories including the second class of vehicle passing records. The first vehicle passing record is the start point of the first classified trajectory, and the last vehicle passing record is the end point of the last classified trajectory.

Figure 8:
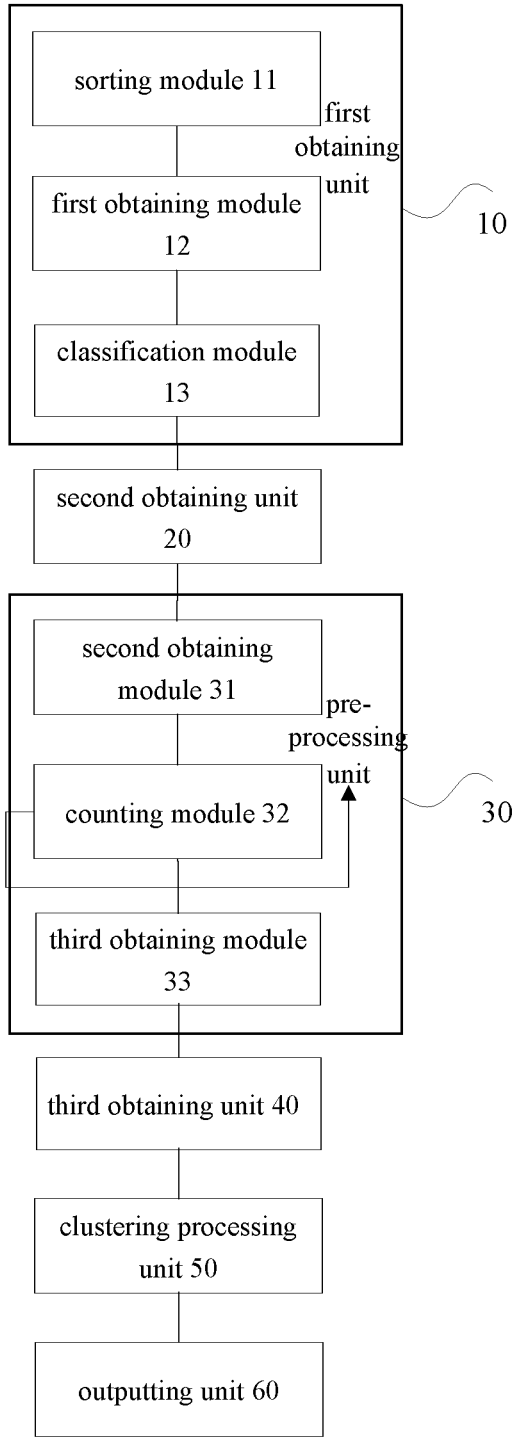
FIG. 8 is a schematic view of a device of processing vehicle passing records according to a third embodiment of the application.

FIG. 8 is a schematic view of a device of processing vehicle passing records according to a third embodiment of the application. As shown in FIG. 8, the device includes: a first obtaining unit 10, a second obtaining unit 20, a pre-processing unit 30, a third obtaining unit 40, a clustering processing unit 50, and an outputting unit 60, wherein, the first obtaining unit 10 includes a sorting module 11, a first obtaining module 12, and a classification module 13, and the pre-processing unit 30 includes a second obtaining module 31, a obtaining module 32, and a third obtaining module 33.

The functions of the first obtaining unit 10, the second obtaining unit 20, the pre-processing unit 30, the third obtaining unit 40, the clustering processing unit 50, the outputting unit 60, the sorting module 11, the first obtaining module 12, and the classification module 13 in the embodiment are the same as in the device of processing vehicle passing records of the second embodiment of the application.

The second obtaining module 31 is configured for obtaining the start point and the end point of each classified trajectory in the vehicle trajectories. A stop point is a location that the preset target object remains without leaving for a second preset time after having stopped. After the vehicle trajectories of the preset target object are obtained, stop point pre-processing of the vehicle trajectories is performed. The second obtaining module 31 obtains the start point and the end point of each classified trajectory in the vehicle trajectories.

The counting module 32 is configured for obtaining the number of times the start point or the end point appears in the first preset time period, wherein, the number of times that the start point or the end point appears in the first preset time period is the number of times that vehicles pass a gate corresponding to the start point or the end point. The obtaining module 32 obtains the number of times that the start point or the end point of each classified trajectory appears in the first preset time period, i.e., the number of times that vehicles pass a gate corresponding to the start point or the end point of each classified trajectory during the first preset time period.

The third obtaining module 33 is configured for obtaining the gate number of the gate corresponding to the start point or the end point, and the number of times that vehicles pass the gate corresponding to the start point or the end point to obtain the pre-processed results. The pre-processed results are obtained through obtaining, via the third obtaining module 33, the gate number of the gate corresponding to the start point or the end point of each classified trajectory, and the number of times that vehicles pass the gate corresponding to the start point or the end point of each classified trajectory.

Figure 9:
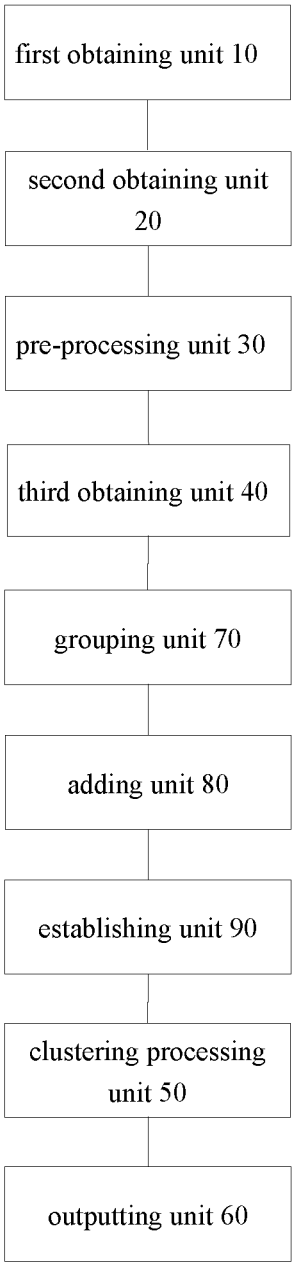
FIG. 9 is a schematic view of a device of processing vehicle passing records according to a fourth embodiment of the application.

FIG. 9 is a schematic view of a device of processing vehicle passing records according to a fourth embodiment of the application. As shown in FIG. 9, the device includes: a first obtaining unit 10, a pre-processing unit 30, a third obtaining unit 40, a clustering processing unit 50, and an outputting unit 60, wherein, it further includes: a grouping unit 70, an adding unit 80, and an establishing unit 90.

The functions of the first obtaining unit 10, the pre-processing unit 30, the third obtaining unit 40, the clustering processing unit 50, and the outputting unit 60 in the embodiment are the same as in the device of processing vehicle passing records of the first embodiment of the application.

The grouping unit 70 is configured for, after obtaining pre-processed records that meet a first preset condition from the pre-processed results, grouping the pre-processed records based on gate number to obtain a plurality of groups of pre-processed records, wherein, the pre-processed records of the same gate number are grouped into one group, and each gate number corresponds to each group of pre-processed records respectively. Specifically, the grouping unit 70 groups the pre-processed records in the plurality of pre-processed results based on gate number, with those having the same gate number being in the same group to obtain a plurality of groups of different gate numbers, each group contains pre-processed records corresponding to the respective gate number.

The adding unit 80 is configured for adding the numbers of times of vehicle passing corresponding to each group of pre-processed records together to obtain the total number of times of vehicle passing corresponding to each group.

The establishing unit 90 is configured for establishing a mapping relationship between each of the plurality of gate numbers and the total number of times of vehicle passing corresponding to each group. The establishing unit 90 establishes a mapping relationship between each of the plurality of gate numbers and the total number of times of vehicle passing corresponding to each group to obtain a set formed by each gate number and the total number of times of vehicle passing corresponding to the gate number.

The first obtaining unit 10 is further configured for obtaining vehicle trajectories of the preset target object during a plurality of preset time periods, and the pre-processing unit 30 is further configured for performing stop point pre-processing on the vehicle trajectories to obtain pre-processing results during the plurality of preset time periods.

Figure 10:
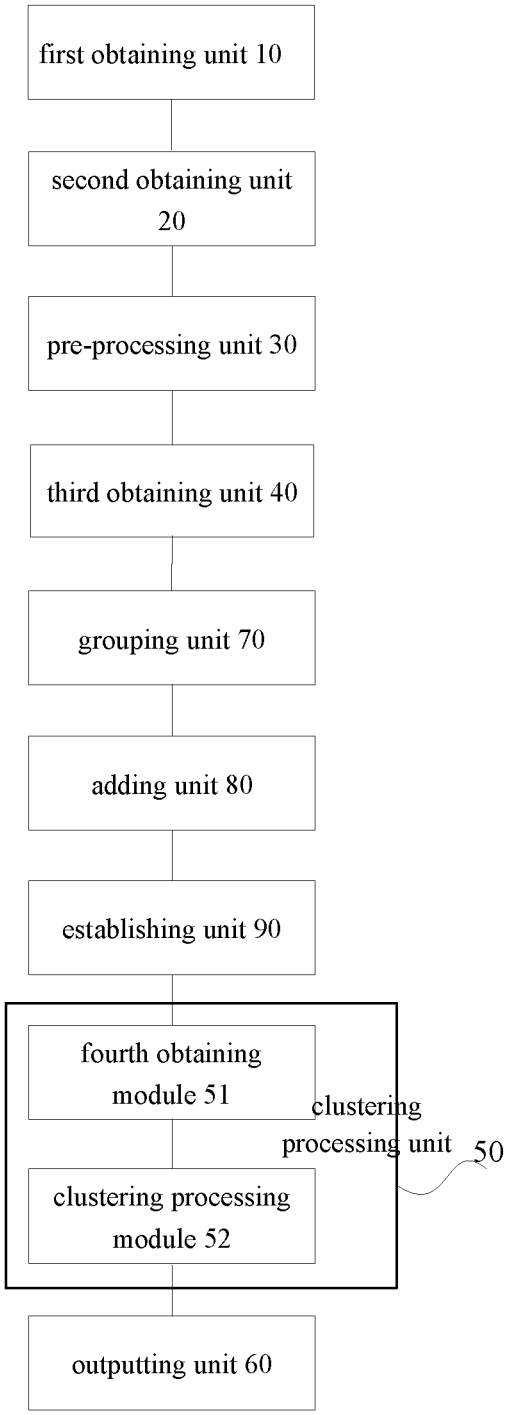
FIG. 10 is a schematic view of a device of processing vehicle passing records according to a fifth embodiment of the application.

FIG. 10 is a schematic view of a device of processing vehicle passing records according to a fifth embodiment of the application. As shown in FIG. 10, the device includes: a first obtaining unit 10, a pre-processing unit 30, a third obtaining unit 40, a clustering processing unit 50, an outputting unit 60, a grouping unit 70, an adding unit 80, and an establishing unit 90, wherein, the clustering processing unit 50 includes a fourth obtaining module 51 and a clustering processing module 52.

The functions of the first obtaining unit 10, the pre-processing unit 30, the third obtaining unit 40, the clustering processing unit 50, the outputting unit 60, the grouping unit 70, the adding unit 80, and the establishing unit 90 in the embodiment are the same as in the device of processing vehicle passing records of the fourth embodiment of the application.

The clustering processing unit 50 is specifically configured for performing clustering processing on the plurality of gate numbers and the total numbers of times of vehicle passing corresponding to the plurality of groups based on the mapping relationship to obtain clustering processing results.

In this case, the fourth obtaining module 51 is configured for obtaining the altitude and latitude information of gates of the plurality of groups.

The clustering processing module 52 is configured for performing clustering processing on the plurality of gate numbers and the total numbers of times of vehicle passing corresponding to the plurality of groups based on the altitude and latitude information of gates of the plurality of groups to obtain a plurality of classes of clustering processing results. In an embodiment of the application, a K-means clustering algorithm is used for clustering into N classes to obtain a plurality of classes of clustering processing results. For example, a plurality of classes of clustering processing results are classified based on the nearness of the location, the gates that are near to a certain degree in location being grouped into one class, said class corresponding to one region.

Figure 11:
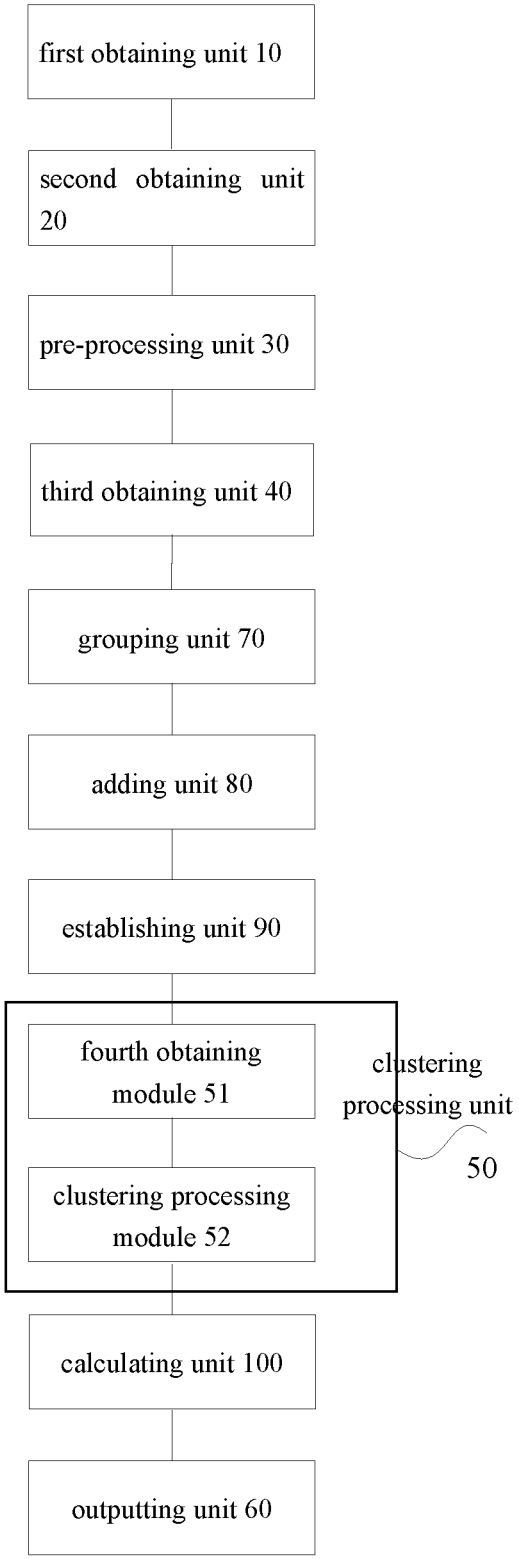
FIG. 11 is a schematic view of a device of processing vehicle passing records according to a sixth embodiment of the application.

FIG. 11 is a schematic view of a device of processing vehicle passing records according to a sixth embodiment of the application. As shown in FIG. 11, the device includes: a first obtaining unit 10, a pre-processing unit 30, a third obtaining unit 40, a clustering processing unit 50, an outputting unit 60, a grouping unit 70, an adding unit 80, and an establishing unit 90, the device further includes a calculating unit 100, wherein, the clustering processing unit 50 further includes a fourth obtaining module 51 and a clustering processing module 52.

The functions of the first obtaining unit 10, the pre-processing unit 30, the third obtaining unit 40, the clustering processing unit 50, the outputting unit 60, the grouping unit 70, the adding unit 80, the establishing unit 90, the fourth obtaining module 51, and the clustering processing module 52 in the embodiment are the same as in the device of processing vehicle passing records of the fifth embodiment of the application.

The calculating unit 100 is configured for, after clustering processing is performed on the pre-processed records to obtain a plurality of classes of clustering processing results, calculating the weight of each class of clustering processing results in the plurality of classes of clustering processing results. The calculating unit 100 calculates the weight of each class of clustering processing results in the plurality of classes of clustering processing results to obtain the weight of a specific class of clustering processing results in all the stop points.

The outputting unit 60 is specifically configured for displaying the plurality of classes of clustering processing results, based on weights, in different regions. Optionally, the outputting unit 60 displays the clustering processing results on a map, a set corresponding to gates of one class being one region, and displays on the map in different colors based on the weights, from light color to dark color, which can represent the change of the weight from small to big.

In embodiments of the device of processing vehicle passing records, the first obtaining unit 10 obtains a plurality of vehicle passing records of a preset target object during a first time period, the second obtaining unit 20 obtains a plurality of vehicle trajectories of the preset target object based on the plurality of vehicle passing records, the pre-processing unit 30 performs stop point pre-processing on vehicle trajectories to obtain pre-processed results, then third the obtaining unit 40 obtains pre-processed records that meet a first preset condition from the pre-processed results, then the clustering processing unit 50 performs clustering processing on the pre-processed records to obtain a plurality of classes of clustering processing results, and the outputting unit 60 finally outputs the clustering processing results, thus reducing the amount of data calculation after pre-processing, obtaining stop point analysis results more rapidly, increasing the accuracy of vehicle stop point analysis, and improving the real time analysis performance of vehicle stop points.

Embodiments of the application determine stop points with the idea of vehicle trajectories, without the need for a user to designate specific outgoing and return time periods, because, if the designated outgoing and return time periods are not the regular travel time periods of a preset target object, then the final obtaining results are merely obtaining pass-through gates and will leave out many stop points. By using the method of vehicle trajectories, the start point and the end point of each classified trajectory in the vehicle trajectories are obtained, and the number of times that the start point or the end point appears in the first preset time period is obtained, without the need to analyze all the vehicle passing records of a designated vehicle license plate during the time period, reducing the difficulty of pre-processing. Moreover, this method is suitable for distributed pre-processing, and different vehicle license plates can be processed in parallel. When analyzing actual stop point, it is only necessary to simply calculate pre-processed data, greatly reducing the amount of calculation, obtaining analysis results more rapidly, and improving the real time analysis performance of stop points. The idea of vehicle trajectories is used to determine stop points. K-means clustering algorithm is used to perform clustering processing on stop point data obtained based on gate. The classes obtained through the K-means clustering algorithm are groups of regions formed by a plurality of gates that are close in location, instead of gates that appear most often. Moreover, weights of stop points in different regions are provided. The determination of stop points is more accurate, while the analysis performance of stop points is improved, improving user experience.

Figure 12:
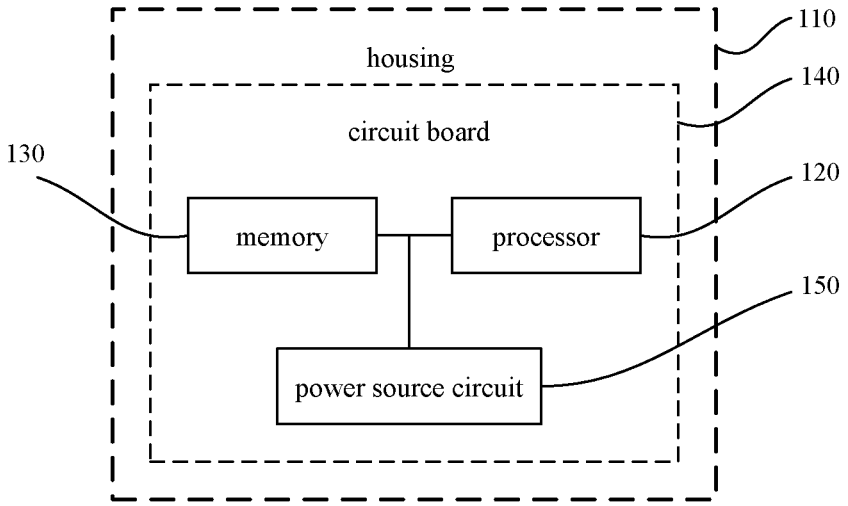
FIG. 12 is a schematic view of an electronic apparatus according to an embodiment of the application.

As shown in FIG. 12, an embodiment of the application provides an electronic apparatus, the electronic apparatus includes: a housing 110, a processor 120, a memory 130, a circuit board 140, and a power source circuit 150, wherein, the circuit board 140 is arranged inside the space enclosed by the housing 110, with the processor 120 and the memory 130 provided on the circuit board 140; the power source circuit 150 is configured for powering various circuits or components of the electronic apparatus; the memory 130 is configured for storing an executable program; the processor 120 implements the following steps by executing the executable program stored in the memory 130:

obtaining a plurality of vehicle passing records of a preset target object during a first preset time period, wherein, each of the vehicle passing records includes a gate number of a gate that the preset target object passes and vehicle passing time when passing the gate;

obtaining a plurality of vehicle trajectories of the preset target object based on the plurality of vehicle passing records;

performing stop point pre-processing on the vehicle trajectories to obtain pre-processed results;

obtaining pre-processed records that meet a first preset condition from the pre-processed results;

performing clustering processing on the pre-processed records to obtain clustering processing results; and, outputting the clustering processing results.

For the specific implementation process of the foregoing step and the further steps implemented via the processor 120 by executing the executable program, reference may be made to the description of the embodiment shown in FIGS. 1-11 of the present application, and details are not described herein again.

As can be seen from above, the embodiments of the application, by obtaining a plurality of vehicle passing records of a preset target object during a first preset time period, then obtaining a plurality of vehicle trajectories of the preset target object based on the plurality of vehicle passing records, performing stop point pre-processing on the vehicle trajectories to obtain pre-processed results, then obtaining pre-processed records that meet a first preset condition from the pre-processed results, performing clustering processing on the pre-processed records to obtain clustering processing results, and finally, outputting the clustering processing results, which reduce the amount of data calculation after pre-processing, thus obtain stop point analysis results more rapidly, increase the accuracy of vehicle stop point analysis, and further improve the real time analysis performance of vehicle stop points.

The electronic apparatus can exist in various forms, including but not limited to:

(1) mobile communication apparatus: this type of apparatus is characterized by having mobile communication function, and provides voice and data communication as the main goal. This type of terminal includes: smartphones (such as iPhone), multimedia cell phones, functional cell phones, and low-end cell phones.

(2) super mobile personal computer apparatus: this type of apparatus belongs to the category of personal computers, with computing and processing functions, and generally also has mobile networking property. This type of terminal includes: PDA, MID, and UMPC apparatus, such as iPad.

(3) portable entertainment apparatus: this type of apparatus can display and play multimedia contents. This type of apparatus includes: audio and video players (such as iPod), hand-held gaming device, ebooks, smart toys, and portable onboard navigation devices.

(4) server: being an apparatus providing computing services, the composition of a server includes: a processor, a hard disk, a memory, a system bus, etc., a server is similar to a general computer architecture, but because it needs to provide highly reliable services, it has relatively high requirements in terms of processing power, reliably, stability, security, expandability, and manageability.

(5) other electronic devices having data interaction functions.

Embodiments of the application provide an executable program for implementing a method of processing vehicle passing records provided by embodiments of the application when being executed, wherein, the method of processing vehicle passing records includes:

obtaining a plurality of vehicle passing records of a preset target object during a first preset time period, wherein, each of the vehicle passing records includes a gate number of a gate that the preset target object passes and vehicle passing time when passing the gate;

obtaining a plurality of vehicle trajectories of the preset target object based on the plurality of vehicle passing records;

performing stop point pre-processing on the vehicle trajectories to obtain pre-processed results;

obtaining pre-processed records that meet a first preset condition from the pre-processed results;

performing clustering processing on the pre-processed records to obtain clustering processing results; and, outputting the clustering processing results.

In embodiments of the application, a plurality of vehicle passing records of a preset target object during a first preset time period are obtained, a plurality of vehicle trajectories of the preset target object are obtained based on the plurality of vehicle passing records, stop point pre-processing of the vehicle trajectories is performed to obtain pre-processed results, then pre-processed records that meet a first preset condition are obtained from the pre-processed results, clustering processing of the pre-processed records is performed to obtain clustering processing results, and finally, the clustering processing results are outputted, reducing the amount of data calculation after the pre-processing, thus obtaining stop point analysis results more rapidly, increasing the accuracy of vehicle stop point analysis, and further improving the real time analysis performance of vehicle stop points.

Embodiments of the application provide a storage medium for storing an executable program, the executable program is used to implement a method of processing vehicle passing records provided by embodiments of the application when being executed, wherein, the method of processing vehicle passing records includes:

obtaining a plurality of vehicle passing records of a preset target object during a first preset time period, wherein, each of the vehicle passing records includes a gate number of a gate that the preset target object passes and vehicle passing time when passing the gate;

obtaining a plurality of vehicle passing records of a preset target object during a first preset time period, wherein, each of the vehicle passing records includes a gate number of a gate that the preset target object passes and vehicle passing time when passing the gate;

obtaining a plurality of vehicle trajectories of the preset target object based on the plurality of vehicle passing records;

performing stop point pre-processing on the vehicle trajectories to obtain pre-processed results;

obtaining pre-processed records that meet a first preset condition from the pre-processed results;

performing clustering processing on the pre-processed records to obtain clustering processing results; and, outputting the clustering processing results.

In embodiments of the application, a plurality of vehicle passing records of a preset target object during a first preset time period are obtained, a plurality of vehicle trajectories of the preset target object are obtained based on the plurality of vehicle passing records, stop point pre-processing of the vehicle trajectories is performed to obtain pre-processed results, then pre-processed records that meet a first preset condition are obtained from the pre-processed results, clustering processing of the pre-processed records is performed to obtain clustering processing results, and finally, the clustering processing results are outputted, reducing the amount of data calculation after the pre-processing, thus obtaining stop point analysis results more rapidly, increasing the accuracy of vehicle stop point analysis, and further improving the real time analysis performance of vehicle stop points.

With respect to embodiments of the device, the electronic apparatus, the executable program, and the storage medium, since they are essentially similar to embodiments of the method, the description is relatively simple, and for relevant parts, reference may be made to the part of the method embodiments.

It is clear for those skilled in the art that the various modules and steps in the embodiments of the present application can be implemented by generic computing devices. They can be integrated in a single computing device, or can be distributed in a network composed of several computing devices. Optically, they can be implemented through executable program which can be executed by computing devices, such that they can be stored in a storage device and implemented by computing devices, or they can be made as various integrated circuit modules, or some of the modules and steps among them can be implemented as a single integrated circuit module. In this way, the present application is not limited to any specific combination of hardware and software.

What have been described above are merely preferred embodiments of the present application, and not intended to limit the scope of protection of the present application. Those skilled in the art can envisage various modifications and variants. Any modifications, equivalent substitutions, improvements within the spirit and principle of the present application all fall within the scope of protection of the present application.

What is claimed is:

1. A method of processing vehicle passing records, comprising:

obtaining a plurality of vehicle passing records of a preset target object during a first preset time period, wherein, each of the vehicle passing records comprises a gate number of a gate that the preset target object passes and vehicle passing time when passing the gate;

obtaining a plurality of vehicle trajectories of the preset target object based on the plurality of vehicle passing records;

performing stop point pre-processing on the vehicle trajectories to obtain pre-processed results by a pre-processing unit;

obtaining pre-processed records that meet a first preset condition from the pre-processed results;

performing clustering processing on the pre-processed record to obtain clustering processing results by a clustering processing unit; and, outputting the clustering processing results.

2. The method of claim 1, wherein, obtaining a plurality of vehicle trajectories of the preset target object based on the plurality of vehicle passing records comprises:

sorting the plurality of vehicle passing records in the order of vehicle passing time;

obtaining time differences between adjacent vehicle passing records;

classifying the plurality of vehicle passing records based on the time differences between adjacent vehicle passing records to obtain classified trajectories, wherein, the plurality of vehicle passing records are classified into a first class of vehicle passing records and a second class of vehicle passing records, the first class of vehicle passing records are adjacent vehicle passing records extracted from the plurality of vehicle passing records whose time differences exceed a second preset time, the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories comprising the second class of vehicle passing records.

3. The method of claim 2, wherein, performing stop point pre-processing on the vehicle trajectories to obtain pre-processed results comprises:

obtaining the start point and the end point of each classified trajectory in the vehicle trajectories;

obtaining the number of times the start point or the end point appears in the first preset time period, wherein, the number of times that the start point or the end point appears in the first preset time period is the number of times that vehicles pass a gate corresponding to the start point or the end point; and, obtaining the gate number of the gate corresponding to the start point or the end point, and the number of times that vehicles pass the gate corresponding to the start point or the end point to obtain the pre-processed results.

4. The method of claim 3, wherein, after obtaining pre-processed records that meet a first preset condition from the pre-processed results, the method further comprises:

grouping the pre-processed records based on gate number to obtain a plurality of groups of pre-processed records, wherein, the pre-processed records of the same gate number are grouped into one group, and each gate number corresponds to each group of pre-processed records respectively;

adding the numbers of times of vehicle passing corresponding to each group of pre-processed records together to obtain the total number of times of vehicle passing corresponding to each group; and, establishing a mapping relationship between each of the plurality of gate numbers and the total number of times of vehicle passing corresponding to each group.

5. The method of claim 4, wherein, performing clustering processing on the pre-processed records to obtain clustering processing results comprises: performing clustering processing on the plurality of gate numbers and the total numbers of times of vehicle passing corresponding to the plurality of groups based on the mapping relationship to obtain clustering processing results, which consists of:

obtaining the altitude and latitude information of gates of the plurality of groups; and, performing clustering processing on the plurality of gate numbers and the total numbers of times of vehicle passing corresponding to the plurality of groups based on the altitude and latitude information of gates of the plurality of groups to obtain a plurality of classes of clustering processing results.

6. The method of claim 5, wherein, after performing clustering processing on the pre-processed records to obtain a plurality of classes of clustering processing results, the method further comprises:

calculating the weight of each class of clustering processing results among the plurality of classes of clustering processing results in the plurality of classes of clustering processing results;

outputting the clustering processing results comprises: displaying the plurality of classes of clustering processing results, in combination with the weights, in different regions.

7. A device of processing vehicle passing records, comprising:

a first obtaining unit, configured for obtaining a plurality of vehicle passing records of a preset target object during a first preset time period, wherein, each of the vehicle passing records comprises a gate number of a gate that the preset target object passes and vehicle passing time when passing the gate;

a second obtaining unit, configured for obtaining a plurality of vehicle trajectories of the preset target object based on the plurality of vehicle passing records;

a pre-processing unit, configured for performing stop point pre-processing on the vehicle trajectories to obtain pre-processed results;

a third obtaining unit, configured for obtaining pre-processed records that meet a first preset condition from the pre-processed results;

a clustering processing unit, configured for performing clustering processing on the pre-processed records to obtain clustering processing results; and an outputting unit, configured for outputting the clustering processing results.

8. The device of claim 7, wherein, the second obtaining unit comprises:

a sorting module, configured for sorting the plurality of vehicle passing records in the order of vehicle passing time;

a first obtaining module, configured for obtaining time differences between adjacent vehicle passing records;

a classification module, configured for classifying the plurality of vehicle passing records based on the time differences between adjacent vehicle passing records to obtain classified trajectories, wherein, the plurality of vehicle passing records are classified into a first class of vehicle passing records and a second class of vehicle passing records, the first class of vehicle passing records are adjacent vehicle passing records extracted from the plurality of vehicle passing records whose time differences exceed a second preset time, the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories comprising the second class of vehicle passing records.

9. The device of claim 8, wherein, the pre-processing unit comprises:

a second obtaining module, configured for obtaining the start point and the end point of each classified trajectory in the vehicle trajectories;

a counting module, configured for obtaining the number of times the start point or the end point appears in the first preset time period, wherein, the number of times that the start point or the end point appears in the first preset time period is the number of times that vehicles pass a gate corresponding to the start point or the end point; and, a third obtaining module, configured for obtaining the gate number of the gate corresponding to the start point or the end point, and the number of times that vehicles pass the gate corresponding to the start point or the end point to obtain the pre-processed results.

10. The device of claim 9, wherein, the device further comprises:

a grouping unit, configured for grouping the pre-processed records based on gate number to obtain a plurality of groups of pre-processed records after obtaining pre-processed records that meet a first preset condition from the pre-processed results, wherein, the pre-processed records of the same gate number are grouped into one group, and each gate number corresponds to each group of pre-processed records respectively;

an adding unit, configured for adding the numbers of times of vehicle passing corresponding to each group of pre-processed records together to obtain the total number of times of vehicle passing corresponding to each group; and, an establishing unit, configured for establishing a mapping relationship between each of the plurality of gate numbers and the total number of times of vehicle passing corresponding to each group.

11. The device of claim 10, wherein, the clustering processing unit is configured for performing clustering processing on the plurality of gate numbers and the total number of times of vehicle passing corresponding to each group based on the mapping relationship to obtain clustering processing results; the clustering processing unit comprises:

a fourth obtaining module, configured for obtaining the altitude and latitude information of gates of the plurality of groups; and, a clustering processing module, configured for performing clustering processing on the plurality of gate numbers and the total number of times of vehicle passing corresponding to each group based on the altitude and latitude information of gates of the plurality of groups to obtain a plurality of classes of clustering processing results.

12. The device of claim 11, wherein, the device further comprises:

a calculating unit, configured for calculating the weight of each class of clustering processing results of the plurality of classes of clustering processing results in the plurality of classes of clustering processing results, after performing clustering processing on the pre-processed records to obtain the plurality of classes of clustering processing results, wherein, the outputting unit is configured for displaying the plurality of classes of clustering processing results, in combination with the weights, in different regions.

13. An electronic apparatus comprising: a housing, a processor, a memory, a circuit board, and a power source circuit, wherein, the circuit board is arranged inside the space enclosed by the housing, the processor and the memory are provided on the circuit board; the power source circuit is configured for powering various circuits or components of the electronic apparatus; the memory is for storing an executable program; the processor implements the method of processing vehicle passing records of claim 1 by executing the executable program stored in the memory.

14. A non-transitory storage medium, wherein the storage medium is configured for storing an executable program, the executable program when being executed, is configured to perform:

obtaining a plurality of vehicle passing records of a preset target object during a first preset time period, wherein, each of the vehicle passing records comprises a gate number of a gate that the preset target object passes and vehicle passing time when passing the gate;

obtaining a plurality of vehicle trajectories of the preset target object based on the plurality of vehicle passing records;

performing stop point pre-processing on the vehicle trajectories to obtain pre-processed results;

obtaining pre-processed records that meet a first preset condition from the pre-processed results;

performing clustering processing on the pre-processed records to obtain clustering processing results; and, outputting the clustering processing results.

15. The storage medium of claim 14, wherein, obtaining a plurality of vehicle trajectories of the preset target object based on the plurality of vehicle passing records comprises:

sorting the plurality of vehicle passing records in the order of vehicle passing time;

obtaining time differences between adjacent vehicle passing records;

classifying the plurality of vehicle passing records based on the time differences between adjacent vehicle passing records to obtain classified trajectories, wherein, the plurality of vehicle passing records are classified into a first class of vehicle passing records and a second class of vehicle passing records, the first class of vehicle passing records are adjacent vehicle passing records extracted from the plurality of vehicle passing records whose time differences exceed a second preset time, the second class of vehicle passing records are adjacent vehicle passing records extracted from the plurality of vehicle passing records whose time differences do not exceed the second preset time, the former vehicle passing record of adjacent vehicle passing records in the first class of vehicle passing records being the end point of a previous classified trajectory, the latter vehicle passing record of the adjacent vehicle passing records in the first class of vehicle passing records being the start point of a next classified trajectory, the classified trajectories comprising the second class of vehicle passing records.

16. The storage medium of claim 15, wherein, performing stop point pre-processing on the vehicle trajectories to obtain pre-processed results comprises:

obtaining the start point and the end point of each classified trajectory in the vehicle trajectories;

obtaining the number of times the start point or the end point appears in the first preset time period, wherein, the number of times that the start point or the end point appears in the first preset time period is the number of times that vehicles pass a gate corresponding to the start point or the end point; and, obtaining the gate number of the gate corresponding to the start point or the end point, and the number of times that vehicles pass the gate corresponding to the start point or the end point to obtain the pre-processed results.

17. The storage medium of claim 16, wherein, after obtaining pre-processed records that meet a first preset condition from the pre-processed results, the executable program is further configured to perform:

grouping the pre-processed records based on gate number to obtain a plurality of groups of pre-processed records, wherein, the pre-processed records of the same gate number are grouped into one group, and each gate number corresponds to each group of pre-processed records respectively;

adding the numbers of times of vehicle passing corresponding to each group of pre-processed records together to obtain the total number of times of vehicle passing corresponding to each group; and, establishing a mapping relationship between each of the plurality of gate numbers and the total number of times of vehicle passing corresponding to each group.

18. The storage medium of claim 17, wherein, performing clustering processing on the pre-processed records to obtain clustering processing results comprises: performing clustering processing on the plurality of gate numbers and the total numbers of times of vehicle passing corresponding to the plurality of groups based on the mapping relationship to obtain clustering processing results, which consists of:

obtaining the altitude and latitude information of gates of the plurality of groups; and, performing clustering processing on the plurality of gate numbers and the total numbers of times of vehicle passing corresponding to the plurality of groups based on the altitude and latitude information of gates of the plurality of groups to obtain a plurality of classes of clustering processing results.

19. The storage medium of claim 18, wherein, after performing clustering processing on the pre-processed records to obtain a plurality of classes of clustering processing results, the executable program is further configured to perform:

calculating the weight of each class of clustering processing results among the plurality of classes of clustering processing results in the plurality of classes of clustering processing results;

outputting the clustering processing results comprises: displaying the plurality of classes of clustering processing results, in combination with the weights, in different regions.

* * * * *